United States Patent [19]

Kawamura

[11] 4,378,761

[45] Apr. 5, 1983

[54] FUEL SUPPLY SYSTEM FOR A MULTI-CYLINDER INTERNAL COMBUSTION ENGINE

[75] Inventor: Yoshihisa Kawamura, Fujisawa, Japan

[73] Assignee: Nissan Motor Co., Ltd., Yokohama, Japan

[21] Appl. No.: 89,266

[22] Filed: Oct. 29, 1979

[30] Foreign Application Priority Data

Nov. 1, 1978 [JP] Japan ..... 53-135031

[51] Int. Cl.[3] ..... F02B 19/10; F02B 75/18

[52] U.S. Cl. ..... 123/52 M; 123/336; 123/470

[58] Field of Search ..... 123/52 M, 188 M, 308, 123/432, 442, 585, 586, 588, 336, 470, 472; 261/46, 78 R, DIG. 12, DIG. 39, DIG. 42

[56] References Cited

U.S. PATENT DOCUMENTS

| | | | |
|---|---|---|---|
| 1,372,740 | 3/1921 | Chandler | 261/46 |
| 1,474,968 | 11/1923 | Henszey | 123/586 |
| 1,737,196 | 11/1929 | Mortenson et al. | 123/586 |
| 1,893,297 | 1/1933 | Moore | 261/46 |
| 1,960,109 | 5/1934 | Huber | 261/46 |
| 2,179,143 | 11/1939 | Brown | 123/432 |
| 2,223,381 | 12/1940 | Mock | 261/46 |
| 4,141,940 | 2/1979 | Dye | 261/23 A |
| 4,171,332 | 10/1979 | Gohnert | 261/DIG. 39 |
| 4,211,191 | 7/1980 | Kawamura | 123/52 M |

FOREIGN PATENT DOCUMENTS

| | | |
|---|---|---|
| 686807 | 1/1940 | Fed. Rep. of Germany . |
| 2216182 | 10/1973 | Fed. Rep. of Germany . |
| 2542620 | 3/1977 | Fed. Rep. of Germany . |
| 2604853 | 8/1977 | Fed. Rep. of Germany . |
| 2235285 | 1/1975 | France . |
| 891240 | 3/1962 | United Kingdom . |
| 1411884 | 10/1975 | United Kingdom . |
| 1471616 | 4/1977 | United Kingdom . |

*Primary Examiner*—Charles J. Myhre
*Assistant Examiner*—W. R. Wolfe
*Attorney, Agent, or Firm*—Schwartz, Jeffery, Schwaab, Mack, Blumenthal & Koch

[57] ABSTRACT

In a multi-cylinder internal combustion engine with a single fuel injection valve provided in a manifold entrance, a fuel supply system including a primary and a secondary passage formed by partitioning the manifold entrance is disclosed wherein the portion of the secondary passage located on the outer circumferential surface of the primary passage in the joined portion of each exit of both passages is formed ring-shaped and the exits face the floor surface of a riser portion. Thus, the fuel supply system makes it possible to maintain satisfactory fuel atomizing characteristics during all driving conditions and to obtain uniform mixture distribution characteristics with respect to each engine cylinder.

11 Claims, 5 Drawing Figures

FUEL SUPPLY SYSTEM FOR A MULTI-CYLINDER INTERNAL COMBUSTION ENGINE

BACKGROUND OF THE INVENTION

The present invention relates to a fuel supply system for a multi-cylinder internal combustion engine, and more particularly to a fuel supply system designed so as to inject a fuel into a manifold entrance. In a spark ignition-type multi-cylinder internal combustion engine, a SPI method (single point injection method) is employed wherein fuel injection is effected with a single fuel injection valve provided in a manifold entrance. The SPI method makes it possible to remarkably simplify the structure of the fuel supply system and reduce the cost thereof, in comparison with a method in which fuel injection is effected with a plurality of fuel injection valves each provided in the intake port of each cylinder, respectively.

However, the SPI method has drawbacks that it is difficult to obtain satisfactory results in a fuel atomizing characteristic and a mixture distribution characteristic.

To eliminate these drawbacks, an attempt is made to cause the fuel being injected from the fuel injection valve to collide against a diffusion plate, thereby effecting the atomization of the fuel. Another attempt is to effect high-speed fuel injection directed to the clearance between the throttle valve and the bore of the manifold in which the throttle valve is rotatably provided, thereby effecting a fuel atomization by the guideline of a high-speed current of air.

However, with these attempts, the fuel partially sticks to the passage wall surface, so that supply responsibility is apt to be lowered.

Moreover, another method is proposed which injects a fuel onto a riser floor subject to exhaust heat, in place of injecting the fuel onto the inner wall surface of the intake passage, thereby vapourizing the fuel.

However, with this method, the fuel flow has a tendency to be influenced by the amount of the intake air. As a result, according to driving conditions, it is likely that the distribution of the mixture becomes unsatisfactory.

A still further method is proposed which introduces air through a bypass passage whose inlet portion is provided around the nozzle of a fuel injection valve, while whose outlet portion is provided in the downstream side of the throttle valve, thereby effecting the fuel atomization. Although this method is effective at the time of extremely low load operation, the atomizing effect is rapidly reduced in the region of medium and high loads.

SUMMARY OF THE INVENTION

With the above in mind, an object of the present invention is to provide a fuel supply system for a multi-cylinder internal combustion engine which maintains satisfactory fuel atomizing characteristics during the all driving conditions.

Another object of the present invention is to provide a fuel supply system for a multi-cylinder internal combustion engine which makes it possible to obtain uniform mixture distribution characteristics with respect to each engine cylinder.

According to the present invention, in a multi-cylinder internal combustion engine with a single fuel injection valve provided in a manifold entrance, a fuel supply system comprises a primary and a secondary passage formed by partitioning the manifold entrance, each passage having a throttle valve rotatably mounted therein, and a fuel injection valve provided in the primary passage wherein the portion of the secondary passage located on the outer circumferential surface of the primary passage in the joining portion of each exit of both passages is formed ring-shaped and the exits face the floor surface of a riser portion.

BRIEF DESCRIPTION OF THE DRAWINGS

The present invention will become more clearly understood from the accompanying description of a preferred embodiment thereof and from the accompanying drawings. Both the description and drawings, however, are not intended to limit the present invention in any way, but are given for the purposes of illustration and elucidation only. In the drawings.

DETAILED DESCRIPTION OF THE PREFERRED EMBODIMENT

The embodiment of a fuel supply system according to the present invention will be described with reference to accompanying drawings.

Figure 1:
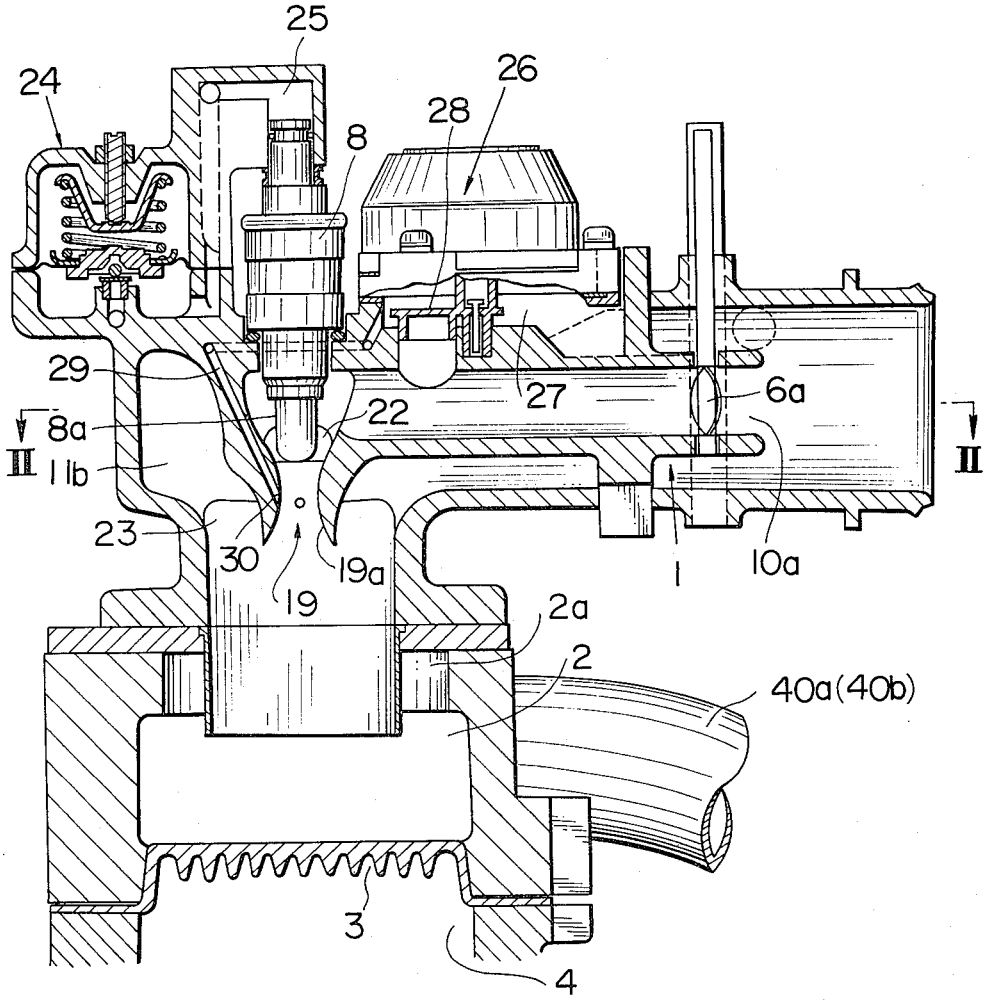
FIG. 1 is an elevational and cross-sectional view illustrating a fuel supply system for a multi-cylinder internal combustion engine according to the present invention.

FIG. 1 shows a manifold in general comprising a manifold entrance 1, a riser portion 2 disposed perpendicularly to the manifold entrance 1, an exhaust passage 4 provided so as to come in contact with a floor surface of the riser portion 2, and a plurality of branch passages 40*a*, 40*b*, . . . each extending through the outside of the riser portion 2 and communicating with each cylinder (not shown), respectively.

Figure 2:
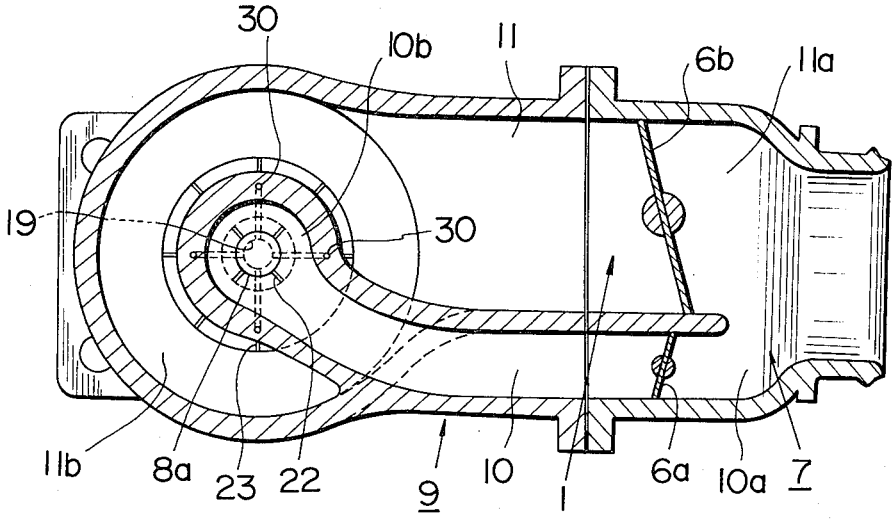
FIG. 2 is a cross sectional view taken along the line II—II of FIG. 1.
Figure 3:
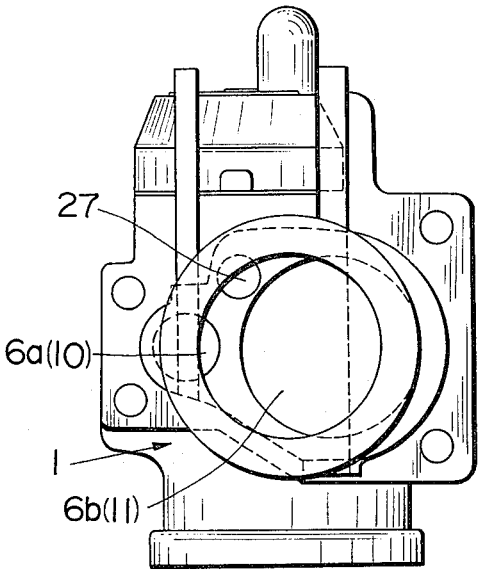
FIG. 3 is a side view of FIG. 1.

As seen from FIG. 2, the manifold entrance 1 comprises a throttle chamber 7 in which two throttle valves 6*a* and 6*b* are provided, and an injection chamber 9 in which a fuel injection valve 8 is provided, which will be described later in more detail. A primary passage 10 and a secondary passage 11 are formed by partitioning a passage consisting of both chambers 7 and 9. The throttle valves 6*a* and 6*b* are disposed at the respective entrances 10*a* and 11*a* of the passages 10 and 11, respectively.

On the other hand, at the exit portions 10*b* and 11*b*, the passages 10 and 11 are formed ring-shaped wherein the secondary passage 11 is concentrically disposed with respect to the outer circumference of the primary passage 10.

It is here noted that the primary passage 10 has a cross-sectional area of the passage sufficient to obtain a predetermined air flow mostly in the region of a low load condition. The secondary passage 11 also has a cross sectional area of the passage sufficient to obtain a predetermined air flow in the region of medium and high loads.

Figure 5:
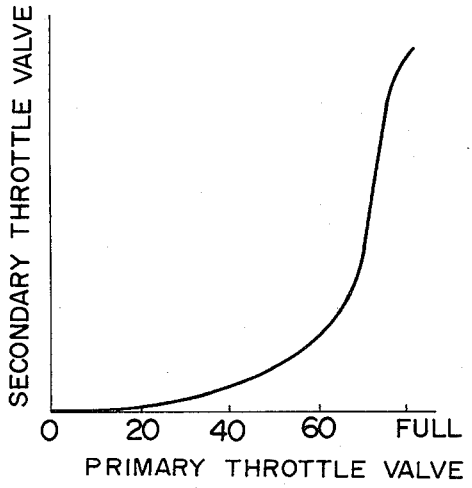
FIG. 5 is a graph illustrating a valve opening characteristic of a primary and a secondary throttle valve of the fuel supply system according to the present invention.

With respect to the primary throttle valve 6a and the secondary throttle valve 6b, it is necessary to present a throttle opening characteristic as shown in FIG. 5.

Figure 4:
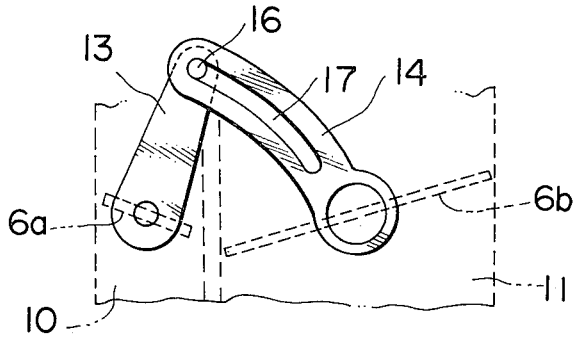
FIG. 4 is a side elevational view illustrating a throttle valve interrelated mechanism employed in the embodiment of the present invention.

For this purpose, a lever 13 of the throttle valve 6a and a lever 14 of the throttle valve 6b are associated as shown in FIG. 4, so as to enable a combined operation via a pin 16 and a slot 17. As long as the locus of the pin 16 becomes approximately coincident with the curved central axis of the slot 17, the opening of the throttle valve 6b is small in comparison with that of the throttle valve 6a. When the opening of the throttle valve 6a exceeds, for instance, about 60°, the throttle valve 6b is rapidly opened.

Therefore, a relatively small but constant amount of air is introduced into the primary passage 10 from a low load to a high load condition, while a large amount of air is introduced into the secondary passage 11 mainly in the region of medium and high loads.

The exit portion 10b of the primary passage 10 is formed with a venturi 19 as is best shown in FIG. 1, thereby squeezing air flow to step up air flow velocity. The injection nozzle 8 of the fuel injection valve 8 is disposed so that it is directed to the central passage of the venturi 19.

Thus, fuel injection in the direction of the corrugated radiation plate 3 of the riser portion 2 through a venturi throat 19a is made possible.

A flow regulating plate 22 for eliminating the directionability of the primary air flow is provided outside the injection nozzle portion 8a. Also, in order to eliminate the directionability of the secondary air flow, another flow regulating plate 23 is provided at the exit 11b of the secondary passage 11. Thus, these flow regulating plates make it possible to increase the uniformity of the distribution of the mixture with respect to each cylinder.

The fuel which is regulated by a pressure regulator 24 is supplied into the fuel injection valve 8 through a passage 25.

The pressure regulator 24 controls the pressure of the fuel injection so as keep a differential pressure constant between intake vacuum pressure downstream of the throttle valve and the fuel supply pressure.

An air regulator 26 is provided so as to bypass air through the throttle valve 6a of the primary passage 10 and then introduce it upstream of the injection nozzle portion 8a.

The air regulator 26 is provided with a thermo-responsive valve 28 for opening or closing a bypass passage 27, thereby making it possible to open the passage 27 in response to the temperature while the engine is cooling. After a predetermined time passes from the starting of the engine, the air regulator 26 becomes operative to automatically close the passage 27 by responding to the heat by means of, for example, a heater (not shown) assembled therein.

In order to constantly maintain a predetermined air flow at the time of idling, there is provided an idle air guide passage 29 communicating with the upstream side of the valve 28 provided in the bypass passage 27. The passage 29 is provided at the throat portion 19a of the venturi 19 with a plurality of branch openings 30 radially disposed therein.

Thus, it is possible to promote the fuel atomization at the time of idling.

Reference is now made to the operation of the fuel supply system according to the present invention.

When the engine is under a low load condition, that is, the opening of the throttle valve 6a is, for example, less than 30°, the opening of the secondary throttle valve 6b is extremely small. Accordingly, air being introduced into the engine passes mostly through the primary passage 10.

The primary air flow has the maximum value in flow speed when passing through the venturi portion 19, and is conducted so as to collide against the corrugated radiation plate 3 of the riser portion 2.

The fuel is injected from the injection nozzle portion 8a of the fuel injection valve 8 in the same direction as the high speed air flow. Accordingly, the fuel is atomized by the high speed air flow and is subject to the heat from the corrugated radiation plate 3, so that fuel evaporation will be effectively promoted. The flow regulating plate 22 prevents the air flow from being partially scattered with respect to the branch passages 40a and 40b communicating with each cylinder, whereby the distribution of the mixture is uniformly effected.

It is to be noted that, even in the region of low-load condition, there is a slight amount of air passing through the secondary passage 11. Therefore, the secondary air flows around the exit of the primary passage 10 perpendicularly projected, thereby moderately preventing the fuel from being attached to the inner wall surface of the passage.

It should be noted that there is an extremely small amount of air flow, such as, for example, in an idling condition even in the region of a low load. In such a case, in comparison with air fuel flowing from the upstream side of the injection nozzle portion 8a, air flow being supplied from the idle air guide passage 29 communicating with the venturi 19 is more than that flowing from the upstream side of the injection nozzle portion 8a. As a result, although the overall air flow is little, it is possible to maintain the atomizing characteristic satisfactory owing to the colliding against the air flow being supplied through the passage 29.

For instance, at the starting time when the engine is cool, the air necessary for effecting idling operation of the engine is introduced into the primary passage 10. Accordingly, fuel atomization is effectively promoted at the time of not only the idling operation, but also warming-up driving, thereby making it possible to maintain stabilization at the time of the idling operation and reducing the warming-up time.

On the other hand, in the region of medium and high loads on the engine, the ratio of the intake air flow being supplied through the secondary throttle valve 6b in addition to the air flow being supplied through the primary throttle valve 6a gradually increases. Air being supplied from the secondary passage 11 and air being supplied from the primary passage 10 are joined together at their respective exits 10a and 11b. This secondary air flow forms an annular-shaped high speed air layer around the venturi portion 19 in which the primary air flows. As a result, the injection fuel riding on the primary air flow is guided by the annular-shaped high speed air layer in such a manner so as not to become attached to the inner wall of the secondary passage 11 and is effectively atomized, thereby maintaining satisfactory fuel atomization efficiency even in the region of medium and high loads.

Furthermore, in the region of medium and high loads, almost all of the air is conducted into the secondary passage 11 having the cross sectional area of the passage sufficiently larger than that of the primary passage 10, thereby increasing the amount of the mixture with good responsive during acceleration, without increasing intake passage resistance.

The fuel supply system according to the present invention makes it possible to atomize the fuel in such a manner so as to allow the fuel to ride on a high speed air flow from the region of a low load to that of a high load condition. Further, the fuel supply device according to the present invention is constituted so as to reduce the amount of the fuel attached to the inner wall surface of the passage and so as not to present a specified direction of an air flow mixture. Accordingly, although fuel injection is effected with the SPI method, a very excellent atomizing characteristic and mixture distribution characteristic are obtained.

Furthermore, the fuel supply device according to the present invention also makes it possible to remarkably improve the acceleration responsiveness and exhaust performance.

It is to be understood that modifications and variations of the embodiments of the invention disclosed herein may be resorted to without departing from the spirit of the invention and the scope of the appended claims.

What is claimed is:

1. A fuel supply system for a single point fuel injection internal combustion engine comprising:

a primary induction air passage in an intake manifold;

a secondary induction air passage defined by partitioning the air intake manifold and positioned on at least a portion of the outer circumference of said primary induction air passage, said secondary induction air passage having an exit where it is joined with said primary induction passage, said exit facing a portion of a floor surface of a riser portion of the intake manifold;

a fuel injection valve provided in said intake manifold adjacent to said exit facing said portion of the floor section of the riser portion;

primary and secondary throttle valves provided in said primary and secondary induction air passages, respectively; and a linking mechanism cooperatively connecting said primary and secondary throttle valves for controlling the rate of opening of said secondary throttle valve in comparison with that of the primary throttle valve is smaller in the region of a low load on the engine than the rate of opening of said secondary throttle valve as compared to that of said primary throttle valve in the region of a high load on the engine.

2. A fuel system for a single point fuel injection internal combustion engine comprising:

a primary induction air passage defined within an air intake manifold;

an annular secondary induction air passage positioned on the circumference of said primary induction air passage having an exit where it is joined with said primary induction air passage, said exit facing a riser portion of the intake manifold;

primary and second throttle valves disposed within said primary and secondary induction air passages, respectively;

a linking mechanism for operatively connecting said primary and secondary throttle valve, said linking mechanism including means for operating said primary and secondary throttle valve in a corresponding relationship whereby the rate of opening of said secondary throttle valve in comparison with that of the primary throttle valve is small in the region of a low engine load condition and the rate of opening of said secondary throttle valve as compared to that of said primary throttle valve rapidly increases in the region of a substantially high engine load condition.

3. A fuel supply system for a single point fuel injection internal combustion engine comprising:

a primary induction air passage defined in an air intake manifold;

a secondary induction air passage surrounding at least a portion of said primary induction air passage and having an exit communicating with said primary induction air passage;

a fuel injection valve positioned in the intake manifold downstream of said secondary induction air passage;

a primary throttle valve disposed within said primary induction air passage for opening and closing the primary induction air passage;

a secondary throttle valve disposed within said secondary induction air passage and operatively associated with said primary throttle valve; and means connecting said primary and secondary throttle valves for operating said secondary throttle valve in a corresponding relationship to the primary throttle valve position, said means limiting the rate of opening of the secondary throttle valve as compared to that of said primary throttle valve when the primary throttle valve angle position is less than a predetermined value and said means rapidly increasing the rate of opening of said secondary throttle valve as compared to that of said primary throttle valve when the primary throttle valve angle position exceeds said predetermined value.

4. A fuel supply system as defined in either claim 1, 2 or 3, wherein said primary induction air passage has a cross sectional area sufficient to maintain an adequate intake flow substantially in the region of a low load and said secondary induction air passage has a cross sectional area sufficient to maintain an adequate intake air flow in the region of medium and high loads.

5. A fuel supply system as defined in either claim 1, 2 or 3, wherein the exit of said secondary induction air passage is a ring-shaped passage concentrically formed with respect to said primary induction air passage, and is provided with a flow regulating plate for a secondary air flow through said secondary induction air passage.

6. A fuel supply system as defined in either claim 1, 2 or 3, which further comprises an air regulator having a bypass passage communicating with said primary induction air passage downstream of said primary throttle valve provided in said primary induction air passage wherein said bypass passage is opened when the engine is cooling.

7. A fuel supply system as defined in either claim 1, 2 or 3, which further comprises an idle air guide passage communicating with said induction air primary passage downstream of said primary throttle valve provided in said primary induction air passage, said idle air guide passage being provided so as to bypass the primary induction air passage.

8. A fuel supply system as defined in claim 7, wherein said idle air guide passage communicates with a throat of said venturi portion.

9. A fuel supply system as defined in either claim 1, 2 or 3, wherein said primary induction air passage is provided with a venturi portion located downstream of a fuel injection nozzle portion of a fuel injection valve.

10. A fuel supply system as defined in claim 9, wherein said injection nozzle portion is disposed with the center thereof located on substantially the same axis as that of said venturi portion.

11. A fuel supply system as defined in claim 10, wherein said injection nozzle portion is provided along the outer circumferential surface thereof with a flow regulating plate for a primary air flow through said primary induction air passage.

* * * * *